US007789394B2

(12) United States Patent
Lendvay

(10) Patent No.: US 7,789,394 B2
(45) Date of Patent: Sep. 7, 2010

(54) SWINGING HORSESHOE GAME

(76) Inventor: Lehel Jozsef Lendvay, 3455 Old Cobble Ct., San Diego, CA (US) 92111

( * ) Notice: Subject to any disclaimer, the term of this patent is extended or adjusted under 35 U.S.C. 154(b) by 0 days.

(21) Appl. No.: 12/463,408

(22) Filed: May 10, 2009

(65) Prior Publication Data

US 2009/0302542 A1 Dec. 10, 2009

Related U.S. Application Data

(60) Provisional application No. 61/060,346, filed on Jun. 10, 2008.

(51) Int. Cl.
*A63B 67/06* (2006.01)
*A63F 7/00* (2006.01)

(52) U.S. Cl. ..... 273/331

(58) Field of Classification Search ..... 273/331, 273/332, 335, 336, 343
See application file for complete search history.

(56) References Cited

U.S. PATENT DOCUMENTS

| | | | | |
|---|---|---|---|---|
| 1,476,038 | A | 12/1923 | Birch | |
| 2,476,635 | A | 4/1947 | Southwick | |
| 2,942,886 | A * | 6/1960 | Ackerman | 273/332 |
| 2,950,917 | A * | 8/1960 | Lyon | 273/332 |
| 3,009,702 | A * | 11/1961 | Lyon | 273/332 |
| 3,762,708 | A * | 10/1973 | Hing | 273/331 |
| 3,953,031 | A | 4/1976 | Kinser | |
| 4,521,016 | A | 6/1985 | Tominaga | |
| 4,685,674 | A | 8/1987 | Toth | |
| 4,898,392 | A * | 2/1990 | Goletz | 273/336 |
| 4,927,159 | A | 5/1990 | Morrissey et al. | |
| 4,952,073 | A * | 8/1990 | Wieland | 383/4 |
| 5,288,083 | A | 2/1994 | Palmieri | |
| D348,910 | S | 7/1994 | Sumner | |
| 5,445,585 | A | 8/1995 | Meeker | |
| 5,766,102 | A | 6/1998 | Lawson et al. | |
| 5,836,836 | A | 11/1998 | Grimes | |
| 5,971,396 | A | 10/1999 | Wieland | |
| 2005/0189717 | A1 | 9/2005 | Wieland | |
| 2009/0302542 | A1 * | 12/2009 | Lendvay | 273/336 |

FOREIGN PATENT DOCUMENTS

JP 05-212143 8/1993

OTHER PUBLICATIONS

See letter to examiner filed on May 10, 2009 entitled "Information Disclosure Statement Regarding Provisional Application".

* cited by examiner

*Primary Examiner*—Raleigh W. Chiu
(74) *Attorney, Agent, or Firm*—George Levy

(57) ABSTRACT

A suspended horseshoe game comprised of a horseshoe, a tether attached at its lower end to the horseshoe, and at its upper end to a supporting structure, and of a target vertical pole. This game consists of swinging the horseshoe toward the target pole such that the horseshoe wraps itself around the target pole.

19 Claims, 15 Drawing Sheets

SWINGING HORSESHOE GAME

This invention claims the benefit of U.S. Provisional Application No. 61/060,346 with the title, "Swinging Horseshoe Game" filed on Jun. 10, 2008 and which is hereby incorporated by reference. Applicant claims priority pursuant to 35 U.S.C. Par 119(e)(i). The present invention relates to horseshoe games, more particularly games in which a suspended horseshoe is aimed by the player at a target. U.S. Pat. Nos. 1,476,038 by Birch, 2,476,635 by Southwick, 5,445,585 by Meeker are thereby incorporated by reference.

FIELD OF THE INVENTION

Background

Throwing games have existed since antiquity. For example, the ancient Olympian games included throwing, as far as possible, a discus in the shape of a circular metal plate. Discus throwing probably gave rise to the game of Quoits which utilizes a circular ring with a four inch hole in the centre and in which the requirement for brute strength is replaced by skills. The quoit is thrown over the "hob"—a pin set in clay within a box-like framework. The clay helps the quoit to remain in place once it has landed. There is evidence of a similar game which was played by Ancient Greeks and Romans.

U-shaped iron plates or shoes have been nailed on horse's hoofs as early as the second century BCE. Sometime in antiquity a horseshoe replaced the quoit and the game of horseshoe throwing began. Since then very little progress has been achieved in modifying or improving this game.

US patent application 20050189717 and U.S. Pat. No. 5,971,396 by Wieland describe a tabletop horseshoe game system in which scaled-down horseshoes are used primarily indoors on a horizontal surface. The game uses a pair of scaled down posts as targets. Wieland's invention also includes a token means to activate the game, a means to change and display scores and to keep track of game time and a means to lower the posts when the game is over, and a vending machine to dispense the horseshoes.

U.S. Pat. No. 4,927,159 by Morrissey describes a game of horseshoes in which the player's legs are used as targets for the horseshoes.

In U.S. Pat. No. 4,685,674 Toth describes an air-swing ball game in which a ball suspended on a string is used to strike and knock down a plurality of pins set up according to a particularized scoring scheme and mounted on a game table having leaves that fold inwardly and upward to create a table useful for other purposes.

None of the prior art offers the entertainment value of this invention. Further features, aspects, and advantages of the present invention over the prior art will be more fully understood when considered with respect to the following detailed description claims and accompanying drawings.

SUMMARY OF THE INVENTION

Figure 1:
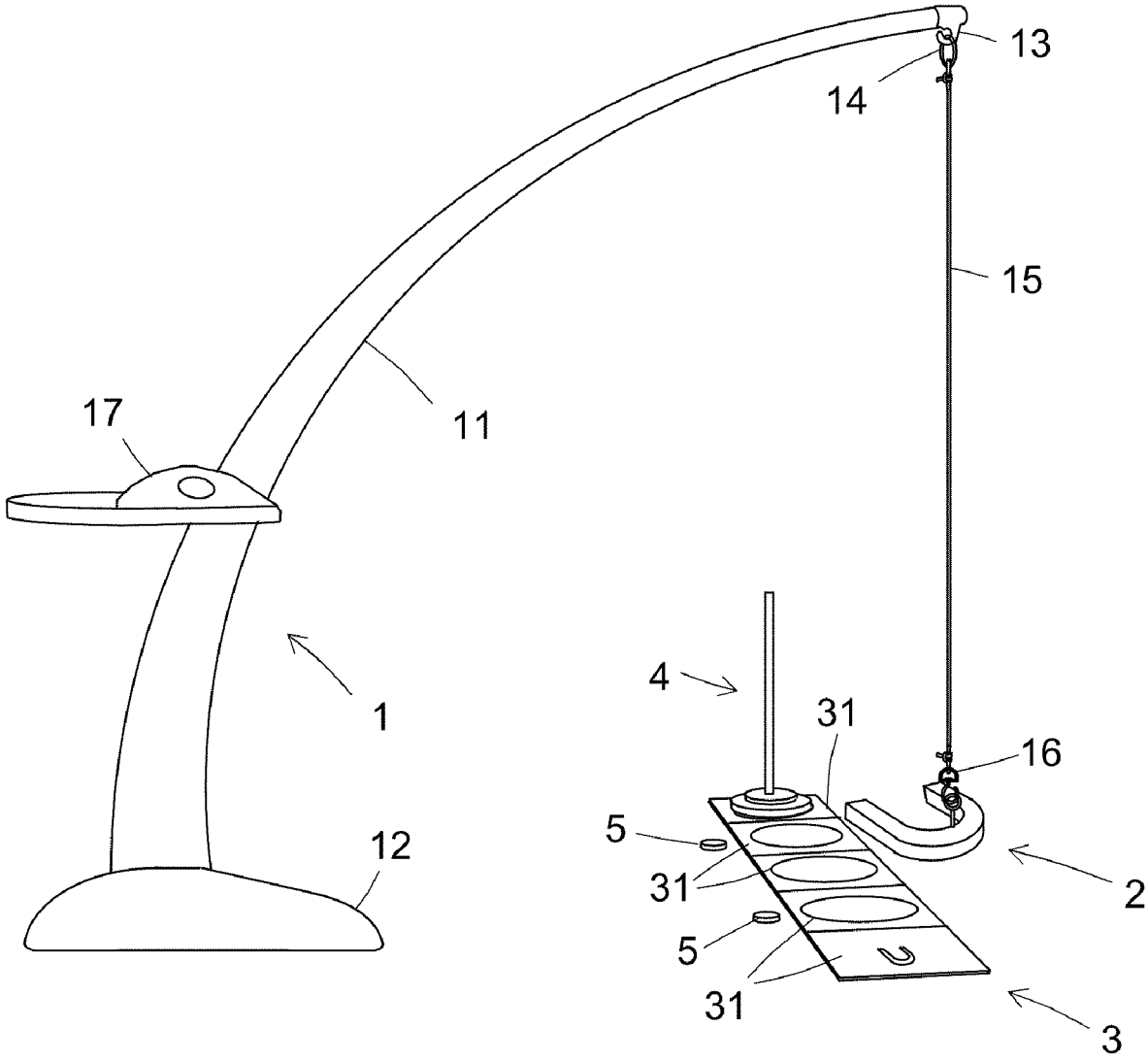
FIG. 1 illustrates the assembled device of the invention. It includes the supporting boom, the base, the hanging cable, the horseshoe, the game board, the target pole with its base, and the markers.

This invention is a suspended horseshoe game that comprises a horseshoe suspended by a tether to a supporting structure and a vertical target pole. The aim of the game is to swing the horseshoe from a distance toward the target pole such that the horseshoe wraps itself around the target pole. The game also comprises a foldable game board comprised of an array of panels arranged in a line. The first panel is located at a position directly under the horseshoe when it is hanging at rest. The other panels are positioned at increasing distance from the first panel. The panels are used as place mat to place the target pole at a reproducible distance from the position of the horseshoe when it hangs at rest. One must note that the panels in the game board could be shaped or represent squares, rectangles, pentagons, hexagons, octagons, stars, animals, or any convenient geometrical figure to represent discrete positions along the board.

The target pole is equipped at its bottom end with a base to enhance its stability and keep it in a vertical position. In addition, the game also comprises a set of markers which are uniquely identifiable and assigned to each player. These markers can be used to mark the position and monitor the progress of the players along the board during the game.

The horseshoe can be maintained in a horizontal position, by loading its base thereby shifting its center of gravity toward the bottom, and by attaching it to the tether at a point directly above its center of gravity when the horseshoe is in a horizontal position.

The inside surface of the horseshoe and outside surface of the target pole can be equipped with fastening material such as VELCRO™ or magnets to ensure that they stick to each other when they come in contact.

The supporting structure can be implemented by means of a supporting boom inserted at its bottom end into a supporting base resting on the ground, and equipped at its top end with a means for attaching the tether. The base can be made hollow to be filled with a liquid such as water or granular material such as sand when the game is in use, to improve its stability, and emptied of these materials to facilitate transportation. The supporting boom can be equipped with a tray to carry drinks or food and can also be equipped with music speakers.

The horseshoes can be provided in different sizes to provide varying degrees of difficulty in the game.

The tether can be attached to the supporting structure by means of different implements: an S shaped bracket is convenient when the supporting structure is a tree branch; a spring-loaded clamp, when the supporting structure is a garage door jamb. Carabiners and cord locks can be used to facilitate the attachment and detachment of the tether.

The supporting structure can take the form of a rod equipped at one end with an attachment device for the tether. The rod could be slid through the roof rack of a car. The rod could also be mounted on a car window by means of a specially adapted bracket.

Playing the game requires the following actions:

a) selecting a launch position behind the game board
b) defining a degree of difficulty of the game by positioning the target pole on one of the panel on the board;
c) Each player, in turn, perform the following steps:
   i) stand at the launch position;
   ii) swing the horseshoe toward the target pole;
   iii) if the player is successful in wrapping the horseshoe around the target pole, then his success can be recorded by moving his marker beside the target pole along the board.

Many variations of the above theme are possible. The winning player is the one that display the greatest skill in wrapping the horseshoe around the target pole.

DETAILED DESCRIPTION

This invention is a game wherein a suspended horseshoe is used to hit a target pole. As shown in FIG. 1 it comprises the following:

a) a suspending structure 1;
b) a horseshoe 2;
c) a game board 3;
d) a target pole 4;
e) playing markers 5.

The suspending structure 1 comprises a curved supporting boom 11 embedded at its lower end into a stabilizing base 12. The upper end of the supporting boom 11 is shaped into a hook 13 through which passes a metal ring 14. A tether 15 in the form of a string, cord or cable is attached at its top end to the metal ring 14 and at its bottom end to the horseshoe 2 which is thereby allowed to swing freely. The attachment point between the horseshoe and the cable includes a swivel 16 to allow the horseshoe 2 to rotate freely.

Figure 2:
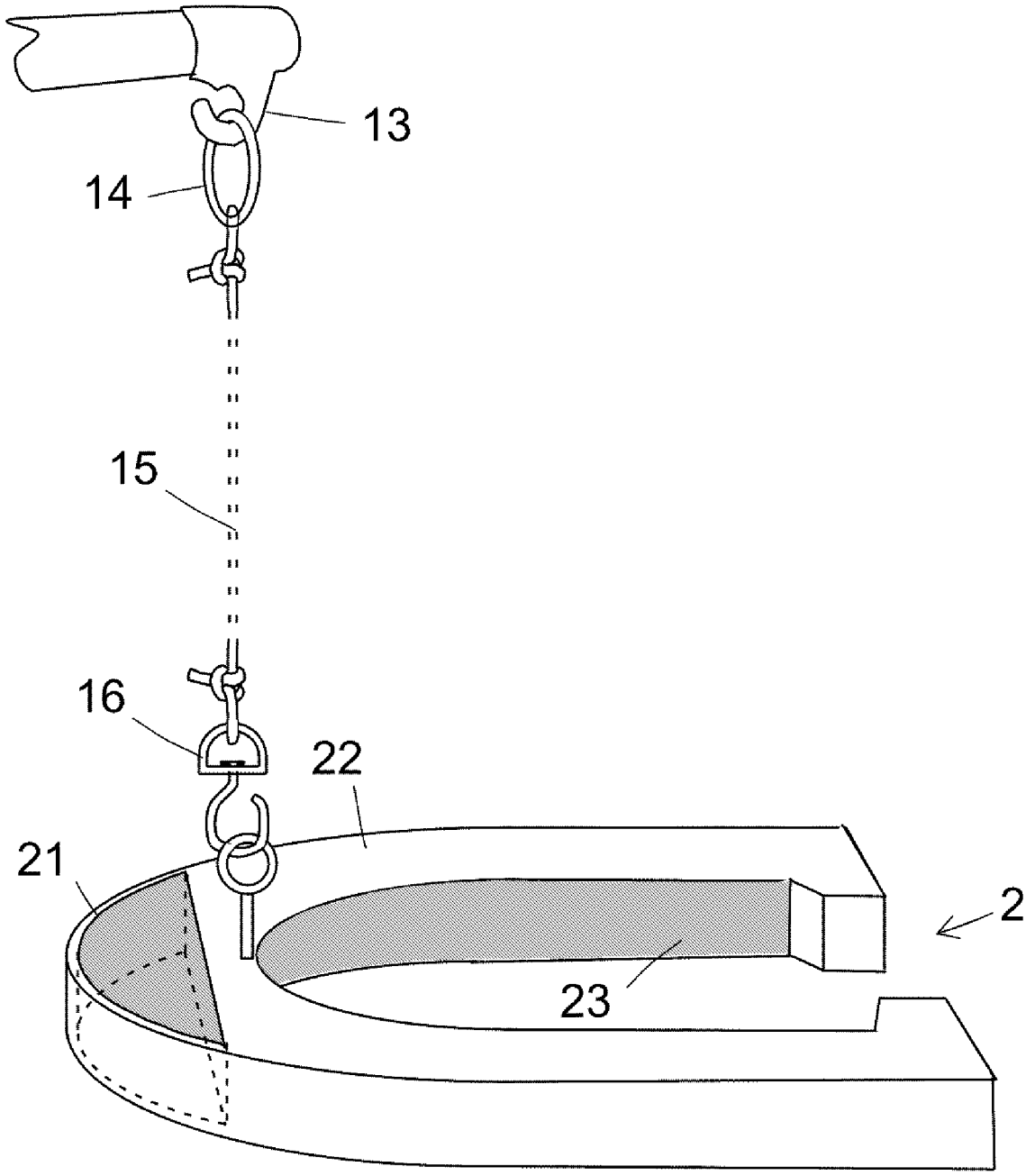
FIG. 2 provides a close up view of the top of the boom and of the horseshoe.

The horseshoe 2 shown in FIG. 2 is designed to remain horizontal when in a suspended resting position. This is accomplished by shifting its center of gravity and placing the attachment point above the center of gravity as shown in FIG. 2. For the purpose of this explanation, we can consider the horseshoe as being U-shaped. The arms of the U are made of light material such as foamy plastic. The bottom of the U contains a stabilizing weight 21 or ballast that shifts the center of gravity toward the bottom of the U. The stabilizing weight 21 made of a heavy material such as iron, is embedded in, and covered by, the light plastic 22 comprising the rest of the horseshoe 2 to minimize the possibility of injury should the horseshoe 2 hit someone during a game. The inside of the U is covered with Velcro™ 23 to enable it to attach itself to a target pole 4.

Figure 2A:
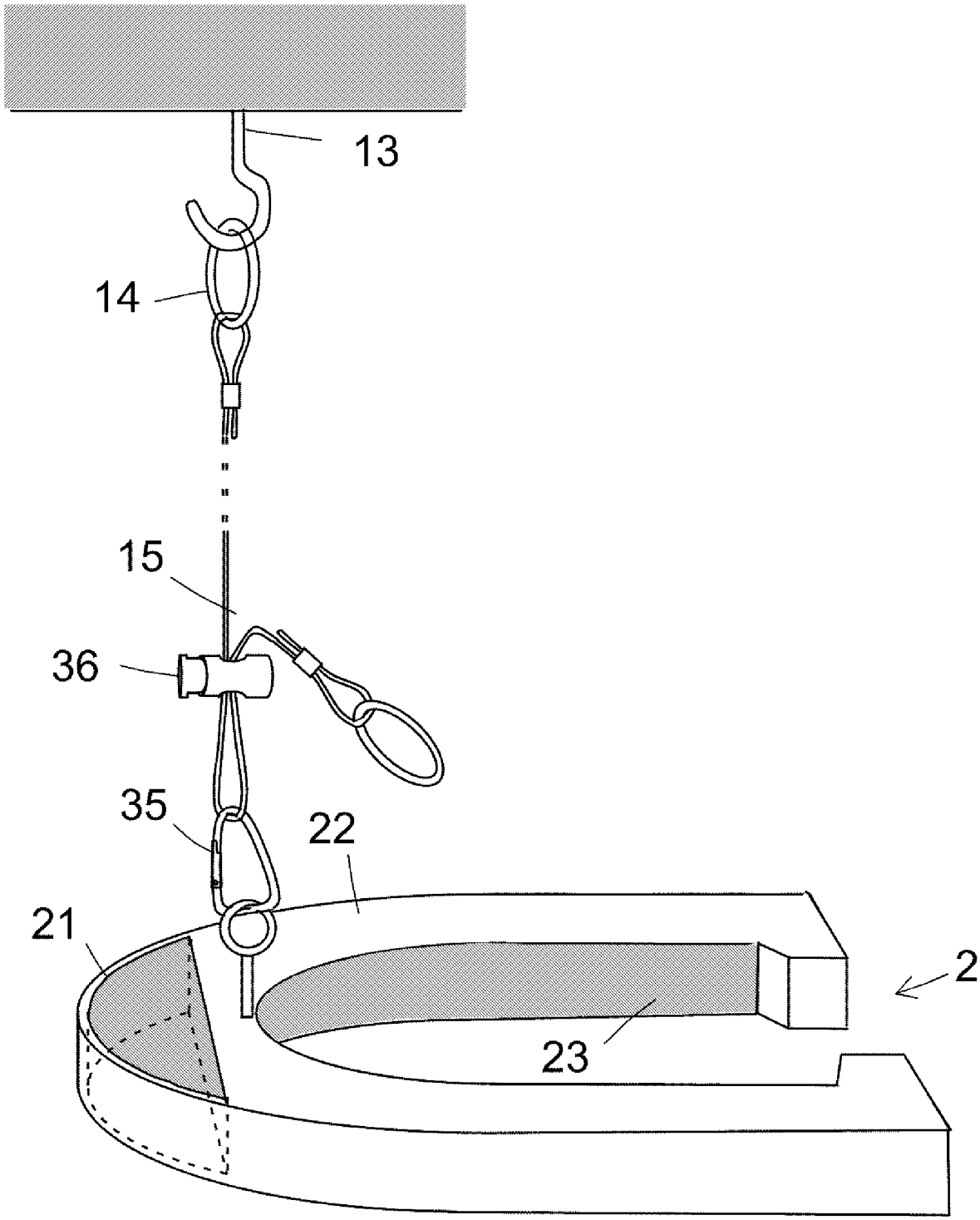
FIG. 2A provides a view of the string attachment. As an option this attachment including a carabiner and a cord lock to facilitate the length adjustment of the supporting string and it attachment to the supporting hook and to the horseshoe.

FIG. 2A provides a variation to the arrangement shown in FIG. 2. A carabiner 35 can be used to facilitate the attachment and detachment of the supporting string 15. A cord lock 36 can be used to adjust the length of the supporting string.

Figure 3:
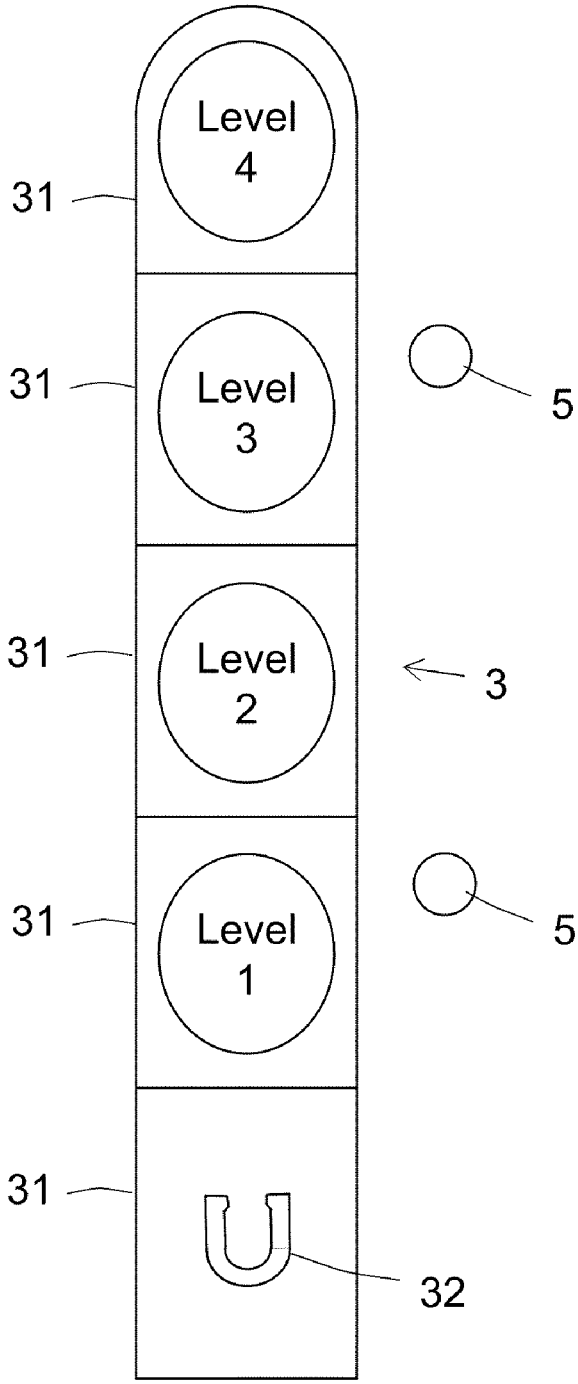
FIG. 3 is a top view of the game board.
Figure 3A:
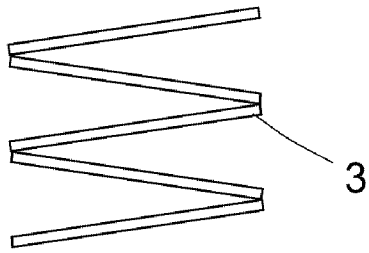
FIG. 3A shows how the game board can be folded accordion style.

The game board 3 shown in FIG. 3 can be made of folding sectional panels 31 to facilitate storage and transport. Each panel 31 corresponds to different degrees of difficulties. The first panel is marked with an image of a horseshoe 32 to indicate that, before the game begins, this panel should be placed below the horseshoe hanging at rest from the string. The player should stand 3 to 4 feet behind this panel. The next panel is labeled with the numeral "1" to indicate the lowest degree of difficulty. The next panel is assigned a degree of difficulty of "2," and so on to the maximum degree which is in the instance shown in the drawing, a degree of difficulty of "4." A person of ordinary skills in the arts will recognize that this game can use different numbers of panels. The game board 3 is shown in FIG. 3A in a partially folded state.

Figure 4:
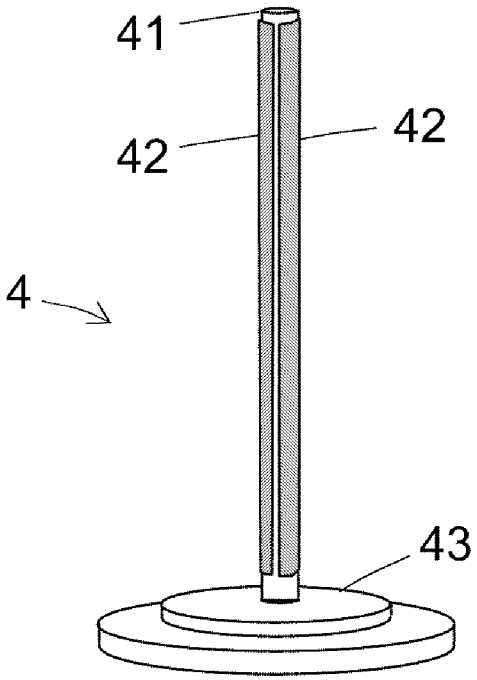
FIG. 4 illustrates a target pole equipped with VELCRO™ all around itself

The target pole 4 shown in FIG. 4 comprises a vertical cylindrical member 41, partially or completely covered with Velcro™ 42 to enable to attach itself to a horseshoe.

Figure 4A:
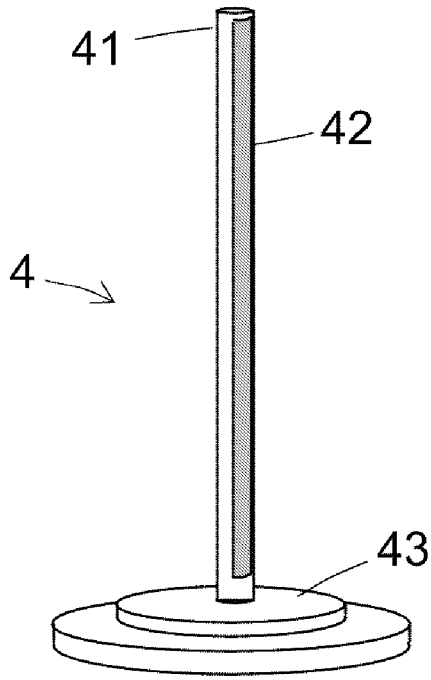
FIG. 4A shows a target pole with VELCRO™ applied partially around the circumference of the pole.

The target poles 4 can be fully or partially covered with Velcro. A partially covered target pole shown in FIG. 4A would increase the degree of difficulty by requiring the horseshoe 2 to hit it at a particular angle for attachment to occur. The partially covered pole 4 could be made to face the player, or could be made to face away from the player to increase the challenge of the game.

Figure 5:
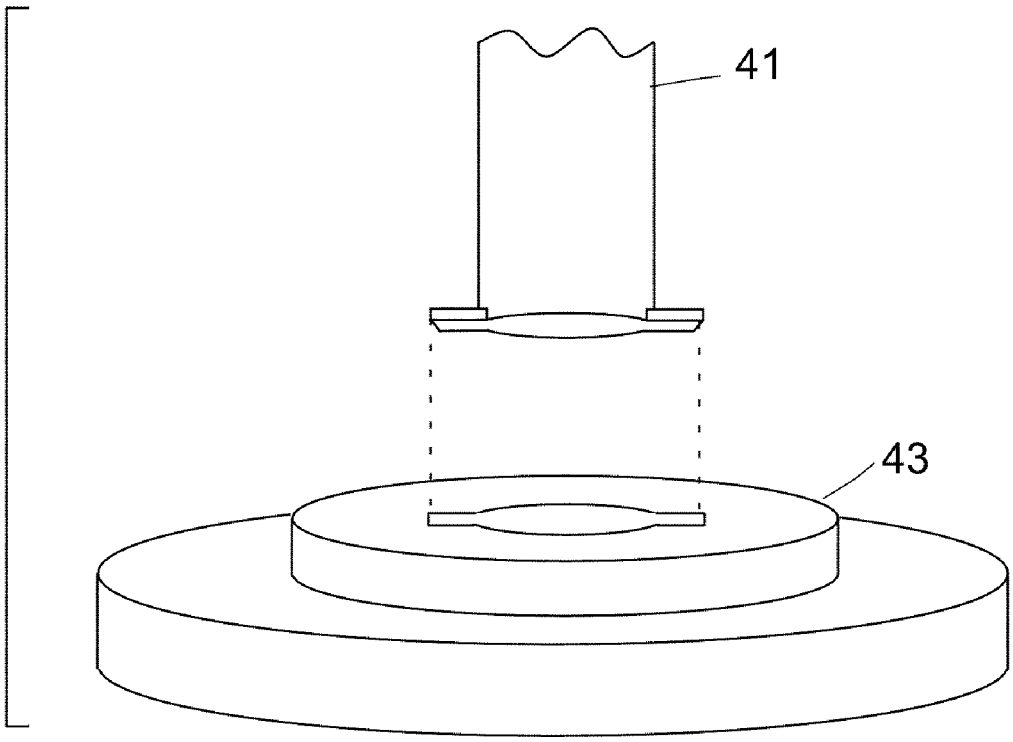
FIG. 5 is an exploded view showing the lower part of the target pole and its supporting base.
Figure 5A:
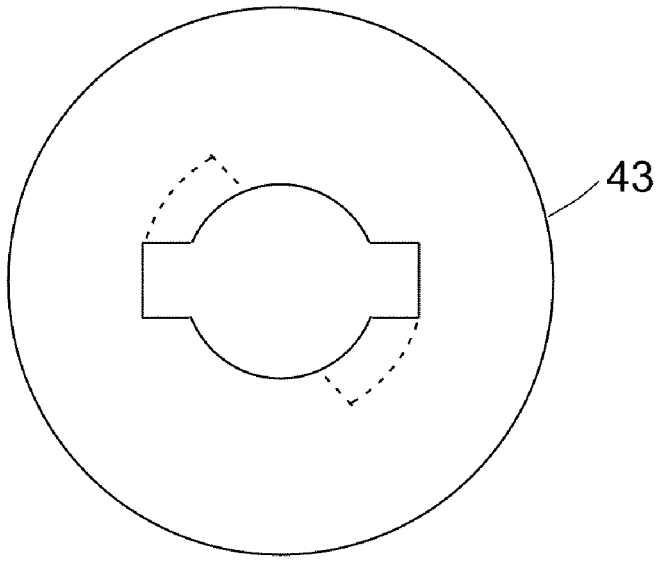
FIG. 5A illustrates the twist and lock mechanism in the supporting base for the target pole.

The pole 41 remains vertical because as shown in FIG. 5 its lower end is inserted into a supporting base 43 and detachably affixed in place by means, for example of a twist and lock mechanism shown in FIG. 5A. The vertical cylindrical member 41 is detachable from its base 43 to facilitate its storage and transport. An additional benefit of locking the pole into the supporting base is that it can be easily picked up and moved by a player to the desired level. There is no need to bend down deep to pick up the supporting base separately because the two are attached and the pole is long enough to allow easy pick up.

The target pole 4 comprised of its cylindrical member 41 and its base 43 are positioned as shown in FIG. 1 on the game board 3, on top of a panel 31 corresponding to the degree of difficulty desired by the players. For example, beginning players may want a low degree of challenge and may choose the closest panel, that is, the one with the lowest degree of difficulty. More experienced players may want to place the target pole 4 further away on a panel with a higher degree of difficulty.

As illustrated in FIG. 3 game markers 5 can be used to keep track of a player's performance. These markers 5 can be in the shape of any small distinguishing object to tell players apart from each other. For example the markers 5 can be in the shape of hockey pucks of different colors, or of animals or birds, or letters. Players, who decide to use the markers to keep track of their progress, would have to assign a different marker to each one. They would then place their own marker next to one of the panels 31 that they have mastered.

Figure 6:
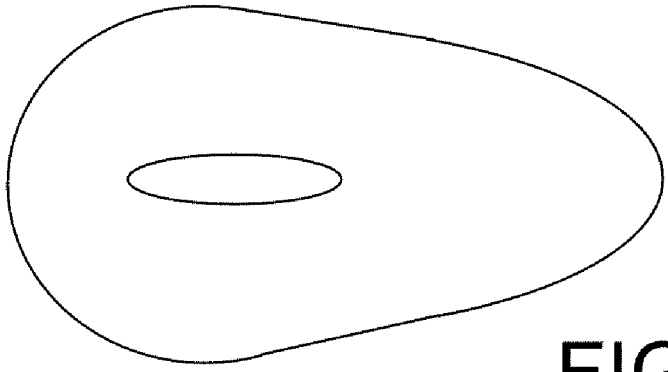
FIG. 6 provides a side view of the supporting base.
Figure 6A:
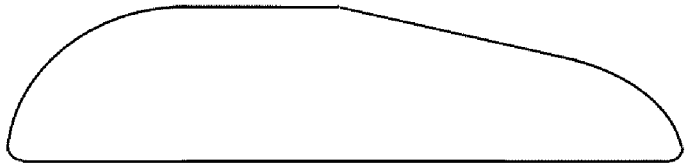
FIG. 6A is a side view of the supporting base.
Figure 6B:
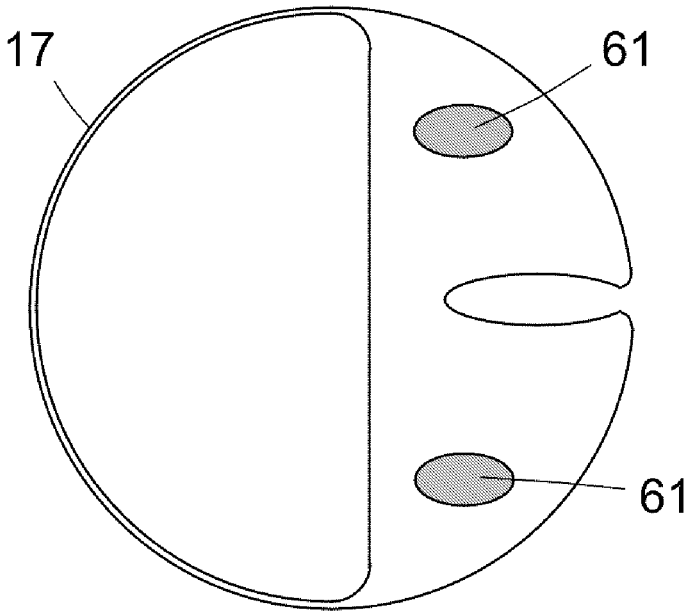
FIG. 6B is a top view of the drink platform equipped with speakers.
Figure 7:
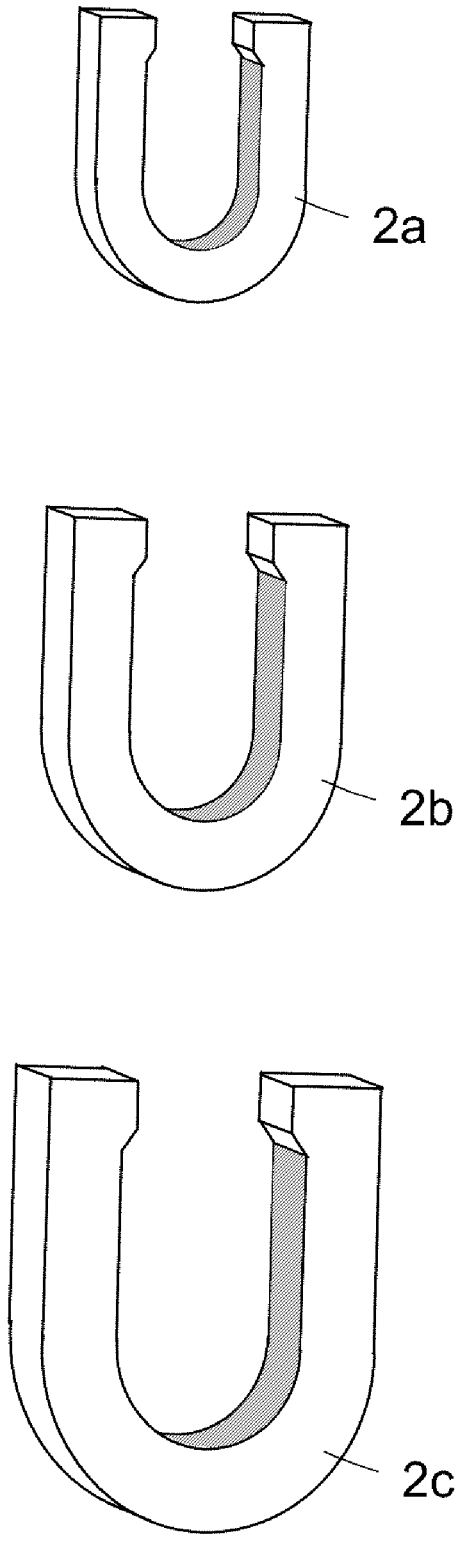
FIG. 7 illustrates how different size horseshoes can be used to provide players with different degrees of difficulties.
Figure 8:
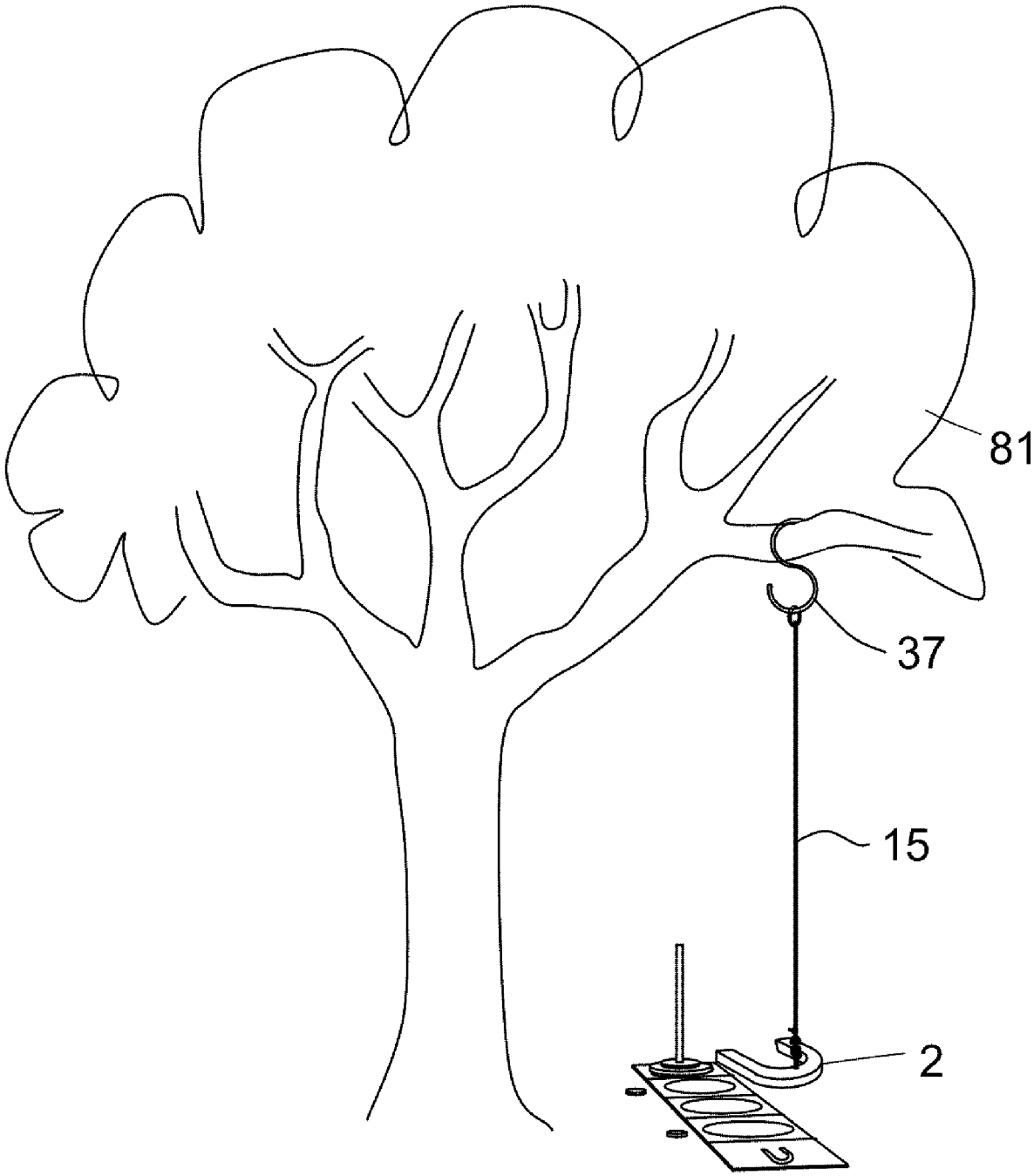
FIG. 8 shows the horseshoe game hanging from a tree.
Figure 9:
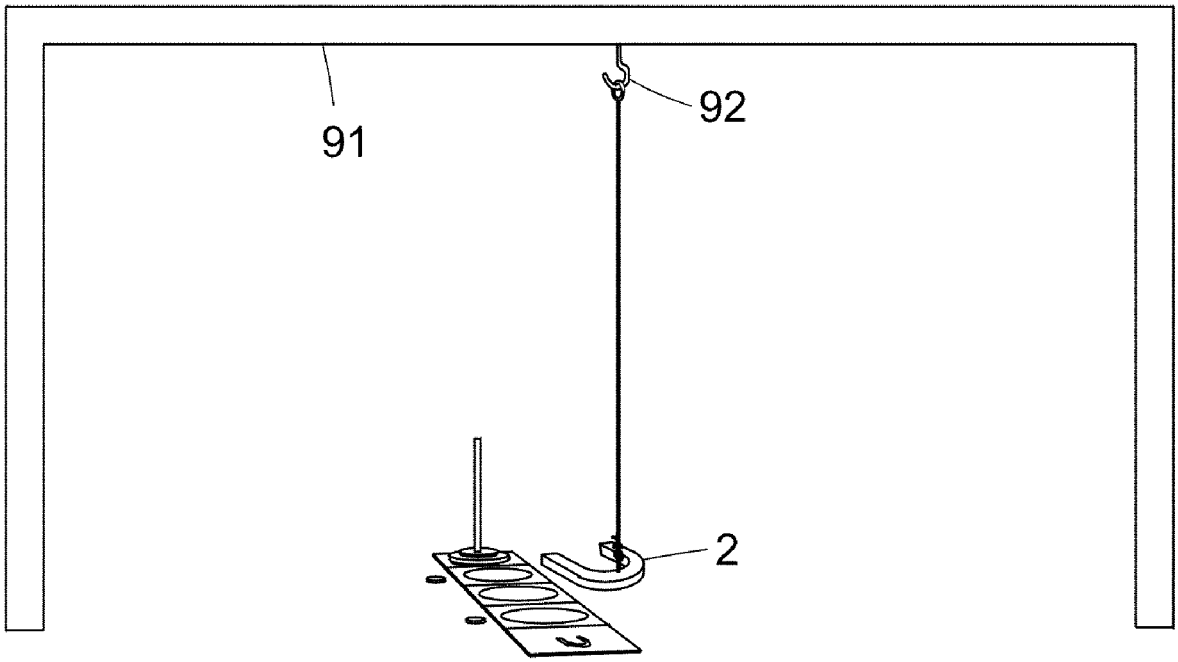
FIG. 9 illustrates the horseshoe game hanging from a garage door.
Figure 10:
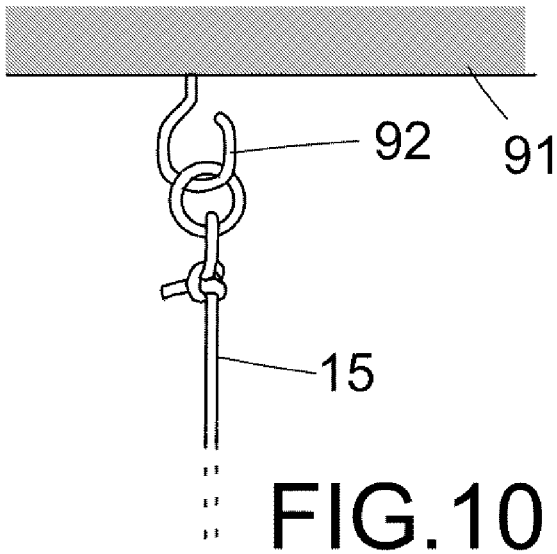
FIG. 10 illustrates how the cable can be attached by means of a hook screwed in the ceiling or on the top part of a door sill.
Figure 10A:
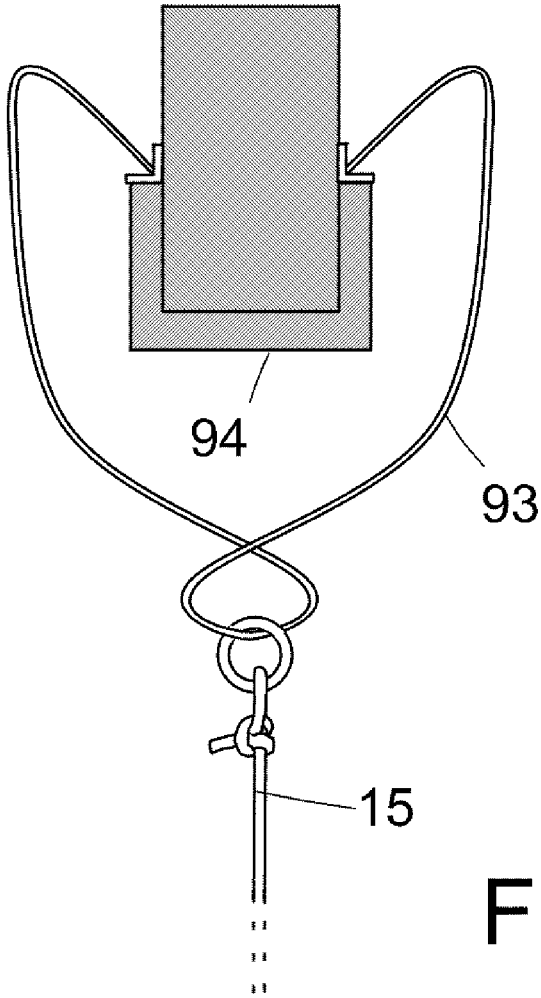
FIG. 10A shows how a clamp can be used to attach the cable to the top of a door sill.
Figure 11:
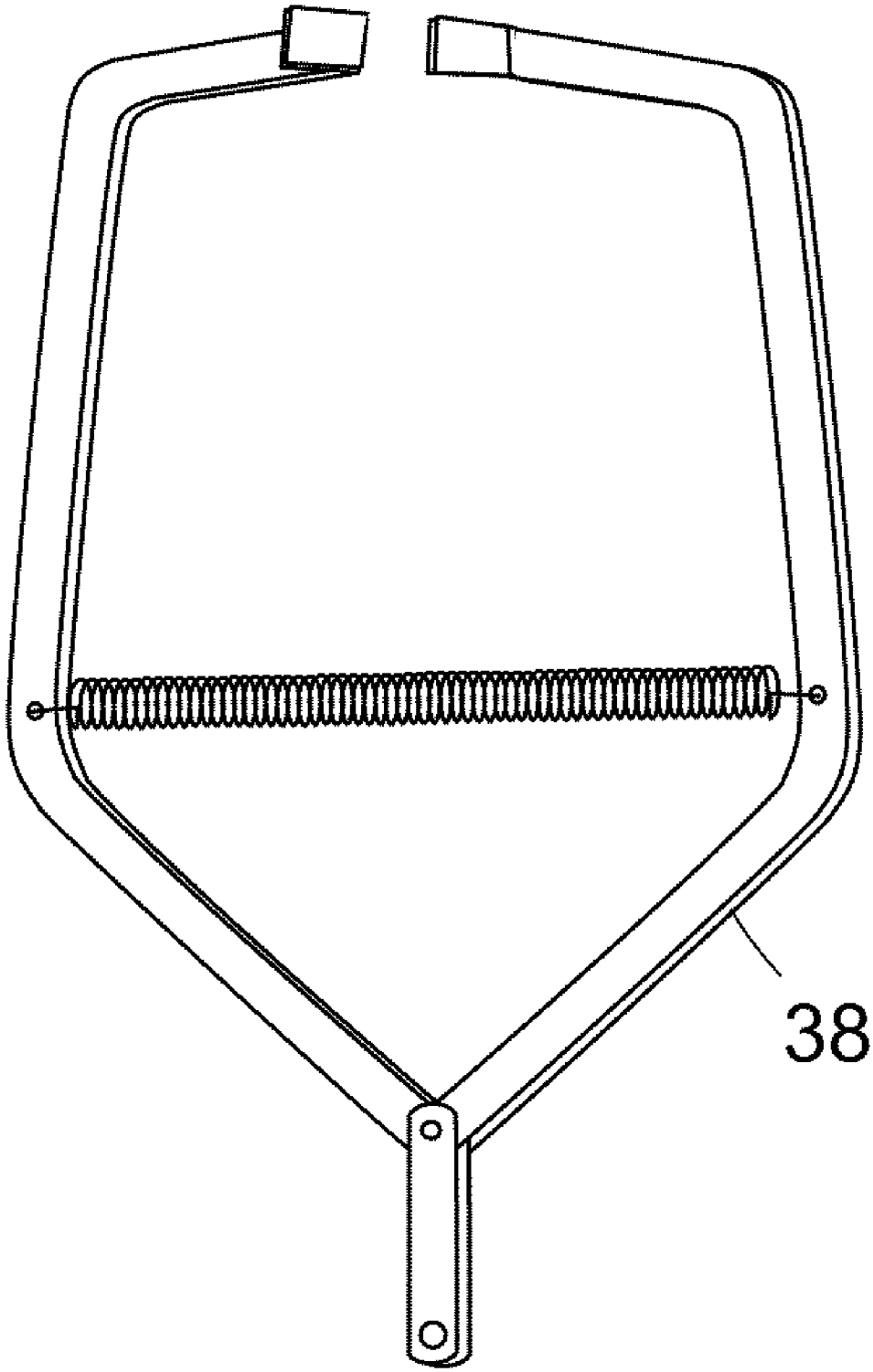
FIG. 11 illustrates a second clamp mechanism for hanging the horseshoe game from a garage door.
Figure 11A:
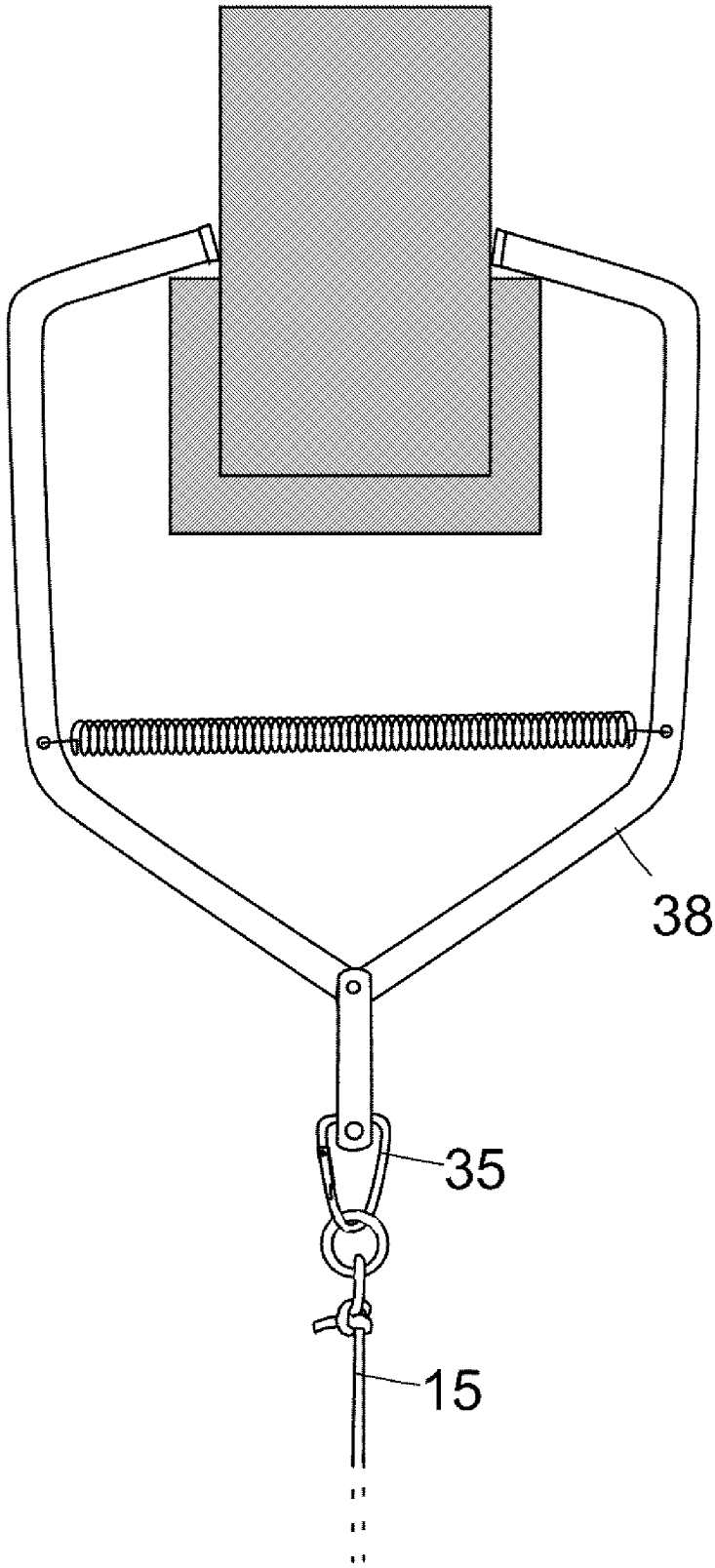
FIG. 11A show the second clamp mechanism attached to a garage door and to the supporting string.
Figure 12:
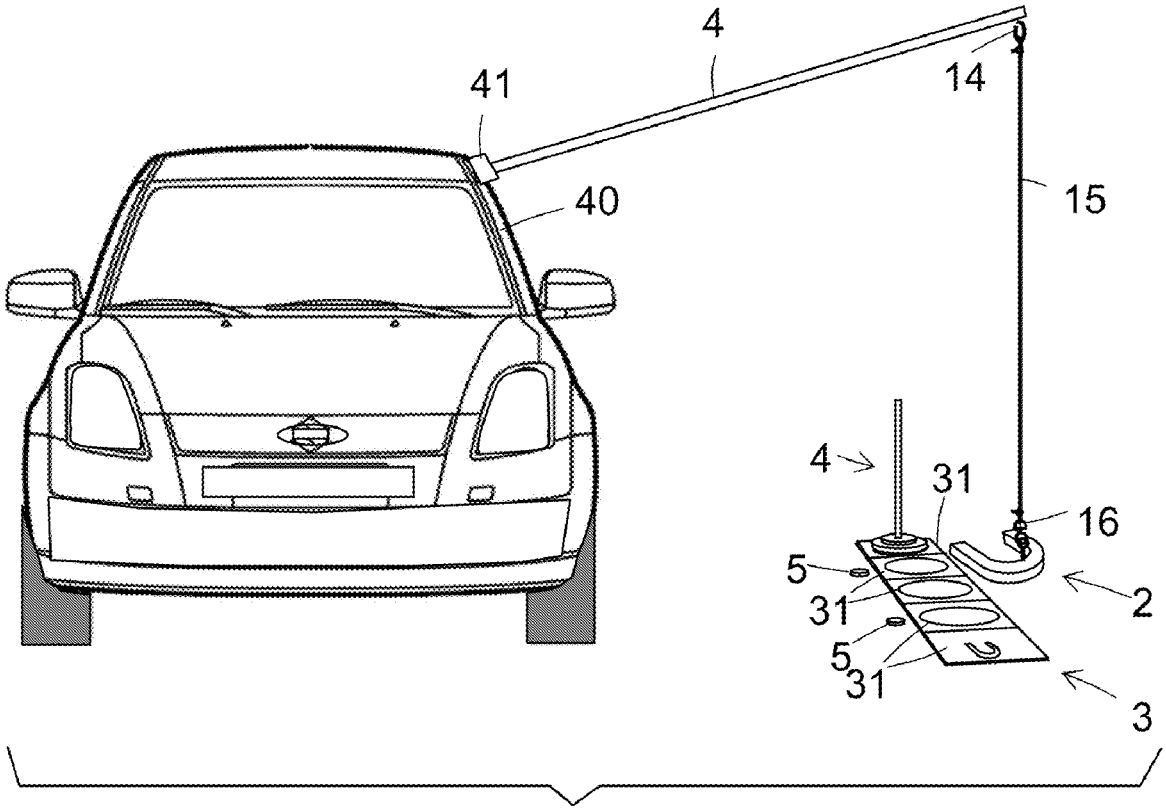
FIG. 12 shows how a clamp can be used to attach a supporting boom to the window of a car.
Figure 12A:
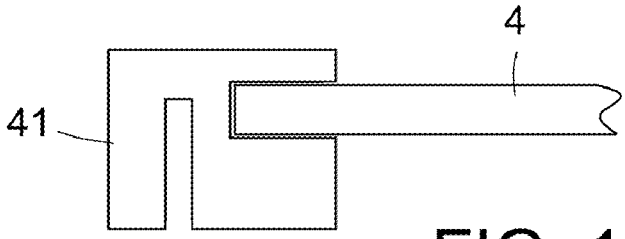
FIG. 12A provides a detailed view of the car window attachment bracket.
Figure 12B:
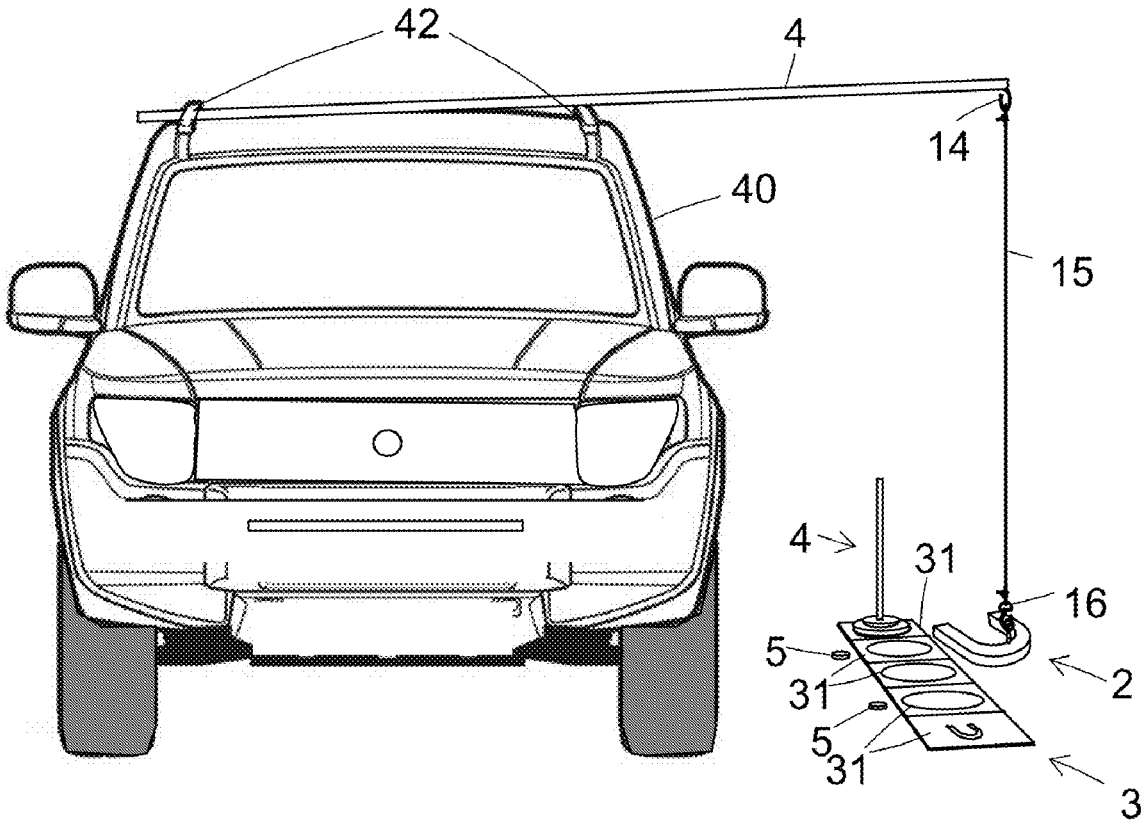
FIG. 12B shows how a supporting boom can be attached to the roof rack of a car.

Numerous variations of this game are possible.

a) The base 12 of the supporting boom 11 is shown in its top view in FIG. 6 and in a side view in FIG. 6A. It could be designed as a container that could, for example, hold sand or water. To facilitate its transport and storage, the base 12 would be left empty. Before use, the base 12 would be filled with sand and water to increase its weight. At the end of the game it would be emptied for transport and storage.

b) A platform 17 shown in FIGS. 1 and 6B could be mounted to the supporting boom 11. Such a platform 17 could be used, for example to hold drinks. Amplified loudspeakers 61 connected to a music player could be also mounted on this platform.

c) Horseshoes 2*a*, 2*b* and 2*c* can be made of different sizes as shown in FIG. 7 to vary the degree of difficulty. In addition the tip of the U can be made more or less open also to vary the degree of difficulty. In the spirit of the equestrian origin of this game, the horseshoes can be named according to their size: Pony 2*a* refers to the smallest horseshoe, Mustang 2*b*, to the midsize one and Clydesdale 2*c* to the largest one.

d) The horseshoe 2 could be suspended from a tree 81 as shown in FIG. 8, thus rendering unnecessary the use of the supporting boom 11 and its base 12. Please note that an S-shaped hook 37 can be used to facilitate the attachment of the supporting string 15.

e) The horseshoe could be supported from a door jamb 91 as shown in FIG. 9, also rendering unnecessary the use of the supporting boom 11 and its base. As illustrated in FIG. 9 and FIG. 10 a hook 92 can be used to hang the horseshoe from the sill of the door 91.

f) FIG. 10A shows an alternate method for hanging the horseshoe 2 to the jamb of a door. A clamp 93 designed to attach to the jamb 94 can be used to hang the cable 15. This clamp 93 has an interesting property caused by the cross over of its arms: the heavier the weight hanging from the cable 15, the tighter the clamping force becomes. Patent literature provides a number of descriptions for clamps designed to fit on door jambs. This particular clamp is described in U.S. Pat. No. 1,476,038 by Birch which is hereby incorporated by reference.

g) Another garage door attachment method illustrated in FIGS. 11 and 11A consists of a spring-loaded clamp 38. FIG. 11 shows the clamp 38 and FIG. 11A shows the clamp 38 attached to the garage door jamb and to the supporting string 15 by means of a carabiner 35.

h) FIG. 12, FIG. 12A and FIG. 12B illustrate how the invention can be mounted on a car 40. In FIG. 12 the invention is mounted on a car 40 by attaching the bottom end of the boom 13 to a bracket 41 mounted on the car's window pane. This bracket is shown in detail in FIG. 12A. In FIG. 12B the boom 13 is mounted on the car 40 by using the roof rack.

i) The VELCRO™ attachment method between the horseshoe 2 and the target pole 4 can be replaced by magnets, electrostatic means (provided the horseshoe is light enough), Gecko-like adhesion means, low adhesion glue such as the kind used in Stick-On™ or other such adhesion means.

j) To minimize the size of the components for shipping and storage, the supporting boom 11 can consist of several segments. The ends of these segments could be shaped to fit into each other to facilitate the assembly of the boom 11.

Purpose of the Game

The game, essentially, consists in swinging the horseshoe 2 toward the target pole 4 such that the horseshoe 2 attaches itself to the target pole 4 by means of the VELCRO™ 23 covering the horseshoe and VELCRO 42 covering the pole 4. It can be played by one or more players. The game board allows the player to distance himself or herself from the board by a set amount to determine the degree of difficulty of the game. Markers 5 allow the players to track their performance.

Clearly the rule for this game can only be limited by the imagination of the players. However, a few set of rules for playing this game are suggested below.

First the game must be set up in a location convenient and safe for the players. The following actions are recommended:

a) Pick a location and method of hanging for the horseshoe.

b) Select and hang the horseshoe: Pony, Mustang, or Clydesdale. Remember, that the smaller the horseshoe the more difficult the game is.

c) Unfold and lay down the game board in the direction of the swings. The horseshoe painted on the first leaf should be exactly under the motionless hanging horseshoe.

d) Each player must now select a game marker. There are markers for six players.

e) Insert the target pole 4 into its base and place it on the first leaf—the one with the inscription "Start Here" of the game board aligned with the outlines of the base.

Version One is called "Up-Hill." The goal in this version is to score at each level and be the first to reach Level 4 and score there too.

a) All players must use the same selected horseshoe during the game.

b) Decide the order of players.

c) Each player should place his marker next to the Level 1 leaf on the right side of the board.

d) The first player places the pole 4 on the $1^{st}$ leaf of the game board inside the outline of the base.

e) Each player has 5 swings in a row then the next player is up. After the last player the first player has 5 swings again, then the next one, etc.

f) To play, each player should stand behind the starting leaf of the game board about 4-5 feet away holding the horseshoe just a little bit above knee height. The player should aim and gently swing the horseshoe toward the target pole 4.

g) If the player does not score then the target pole 4 must stay in place. If this was the player's $5^{th}$ swing then the player should move his/her marker next to the current level on the right side of the leaf and hand the horseshoe to the next player.

h) If the player scores (horseshoe 2 sticks to the pole 4) and he still has one or more swings left from the allowed 5 then the pole 4 is moved to the next level. If the player scores and does not have anymore swings left then he should place his or her marker to the right side of the next leaf and hand the horseshoe to the next player.

i) The next player should place the pole 4 on the leaf where his or her color marker is.

Determining the winner in Version One: there could be two methods of deciding. It is up to the players.

a) The first method is merciless and somewhat unfair: The winner is the first player who reaches and scores at Level 4. The drawback of this is that it gives advantage to the person who starts before the others.

b) The second method is the fair one. If a player reaches and scores on the $4^{th}$ level he/she is the winner if no other player reached and scored on the $4^{th}$ level after all the players finished with their latest round of 5 swings each. In case of a tie the tied players shall swing 5 times at the $4^{th}$ level. The person with the most scores win. In case of another tie the game can be repeated until one winner emerges.

Version Two is called "Round Trip" The goal in this version is to score at each of the following levels: 1, 2, 3, 4, 3, 2, 1 (round trip) and be the first to reach and score on level 1 again. The rules are the same as the Up-Hill game's rules. The difference is that after reaching the $4^{th}$ level the player moves the pole 4 to the $3^{rd}$, then the $2^{nd}$ and to $1^{st}$ level. On the return trip the player places the color marker on the left side of the game board next to the level reached to indicate that the first leg of the trip has already been accomplished.

Determining the winner in Version Two: again, there could be two methods of deciding. It is up to the players!

a) The first method is merciless and somewhat unfair: The winner is the first player who reaches and scores at Level 1 on the return leg of the trip. The drawback of this method is that it gives advantage to the person who starts before the others.

b) This second method is the fair one. If a player reaches and scores on the $1^{st}$ Level he/she is the winner if no other player reached and scored on the $1^{st}$ Level after all the players finished with their latest round of 5 swings each. In case of a tie the tied players shall swing 5 times at the $4^{th}$ level. The person with the most scores win. In case of another tie the game can be repeated until one winner emerges.

Other examples of games using this invention. There are many ways to use the hardware described in this invention.

a) As explained in the above rules the players can start at the lowest level. Every time they master a level by successfully swinging the horseshoe 2 at the target pole 4 a given number of times, they would go up one level. The winner would be the first one who reaches the top level.

b) Players may choose to use and place the partially covered target pole 4 in such fashion that the VELCRO™ covered side is not directly facing the player. This would make scoring much harder requiring skillful sideways swinging of the horseshoe. The game could progress by orienting the pole 4 such that the VELCRO™ covered side faces, in turn, the south, west, north, and east directions. Each player would then be required to score for each orientation of the pole 4 before moving to the next level.

c) Players may be forced to hit the target pole 4 through a circuitous route, from the side, or from the back. This version may be implemented by positioning an intermediate pole in the straight line between the player and the target pole 4. Hitting the intermediate pole would be disallowed and would cost players some points. To hit the target pole 4, players would then be forced to launch the horseshoe 2 along an arc.

d) Players may be required to launch the horseshoe 2 such that it performs a number of 360 degree turns on itself (around the axis of the supporting cable) before it hits and attaches itself to the target 4. A lesser or greater number of turns than allowed would be penalized.

e) A player may be required to launch the horseshoe 2 and then move his or her body quickly to overtake the horseshoe 2 and cross its path before it hits and attaches itself to the target 4. Another variation on this theme is that the player may be required to perform a particular act such as but not limited to jumping, spinning, tumbling, dancing, and somersaulting, while he or she is crossing the horseshoe's path.

While the above description contains much specificity, the reader should not construe this as limitations on the scope of the invention, but merely as examples of preferred embodiments thereof. Those skilled in the art will envision many other possible variations within its scope. Accordingly, the reader is requested to determine the scope of the invention by the appended claims and their legal equivalents, and not by the examples which have been given.

I claim:

1. A suspended horseshoe game comprised of:

a) a horseshoe;

b) a tether attached at its lower end to said horseshoe, and at its upper end to a supporting structure; and c) a target comprising an essentially vertical pole, whereby said game consists of swinging said horseshoe toward said target pole such that said horseshoe wraps itself around said target pole.

2. A suspended horseshoe game of claim 1 also comprising:

a) a game board positioned on the ground below said hanging horseshoe, said board comprising:

i) an array of panels arranged in a line, first of said panels, located at a position directly under said horseshoe hanging at rest, others of said panels positioned at increasing distance from said first panels;

b) and furthermore wherein said target pole includes a base at its lower end;

whereby said target pole can remain in a stable vertical position and said panels being used as place mat to place said target pole at a reproducible distance from the position of said horseshoe when it hangs at rest.

3. A suspended horseshoe game of claim 2 wherein said panel represents a shape selected from the group consisting of squares, rectangles, pentagons, hexagons, octagons, circles, ovals, stars, and animals.

4. A suspended horseshoe game of claim 2 also comprising a set of markers, each said marker being uniquely identifiable, furthermore, each said marker being assigned to each player of said game, whereby said markers can be used by said players to mark the position and monitor the progress of said players, along said game board.

5. A suspended horseshoe game of claim 2 wherein said game board is foldable.

6. A suspended horseshoe game of claim 1 wherein:

a) said horseshoe, essentially in the shape of a U, has its weight more concentrated at the bottom of, than in the arms of, said U, thereby shifting its center of gravity toward the bottom of said U; and b) said tether is attached to said horseshoe at an attachment point on said horseshoe, said attachment point essentially located above the center of gravity of said horseshoe when said horseshoe is in the horizontal position, thereby allowing said horseshoe to remain in the horizontal position as it hangs from said tether.

7. A suspended horseshoe game of claim 1 wherein said target pole is covered with a first fastening means and said horseshoe which forms a U-shape, is also covered on the inside of said U-shape with a second fastening means, said first fastening means capable of adhering to said second fastening means, thereby ensuring that said horseshoe and said target pole can adhere to each other when they come in contact.

8. A suspended horseshoe game of claim 7 wherein said first fastening means and second fastening means are complementary VELCRO™ material.

9. A suspended horseshoe game of claim 7 wherein said first fastening means and second fastening means include magnetically active material.

10. A suspended horseshoe game of claim 1 wherein said supporting means comprises a supporting boom inserted at its bottom end into a supporting base resting on the ground, and equipped at its top end with a means for attaching said tether.

11. A suspended horseshoe game of claim 10 wherein said supporting base is hollow and can be filled with a liquid or granular material to improve its stability when said game is in use, and emptied of said material to facilitate transportation of said game.

12. A suspended horseshoe game of claim 10 wherein said supporting boom is equipped with a tray.

13. A suspended horseshoe game of claim 10 wherein said supporting boom is equipped with music speakers.

14. A suspended horseshoe game of claim 1 wherein said horseshoe is available in different sizes to provide varying degrees of difficulty in said game.

15. A suspended horseshoe game of claim 1 wherein said tether is equipped at its upper end with an S shaped bracket whereby the attachment of said tether to said supporting structure is facilitated when said supporting structure is a tree branch.

16. A suspended horseshoe game of claim 1 wherein said tether is equipped at its upper end with a spring-loaded clamp whereby the attachment of said tether to said supporting structure is facilitated when said supporting structure is a door jamb.

17. A suspended horseshoe game of claim 1 wherein said tether is equipped with at least one carabiner thereby facilitating attachment and removal of said tether.

18. A suspended horseshoe game of claim 1 wherein said supporting structure comprises a) a rod equipped at its first end with a means for attaching said tether;

b) a bracket adapted to be mounted on a car window and also adapted to support second end of said rod.

19. A suspended horseshoe game of claim 1 wherein said supporting structure comprises a rod equipped at its first end with a means for attaching said tether, said rod adapted to fit through, and be supported by, the roof rack of a car.

* * * * *